US010421647B2

(12) United States Patent
Hesselbein

(10) Patent No.: US 10,421,647 B2
(45) Date of Patent: Sep. 24, 2019

(54) DEVICE FOR MONITORING OPERATING DATA AND/OR DETERMINING THE REPLACEMENT STATE OF WEAR OF A CABLE DURING USE ON LIFTING APPARATUSES

(71) Applicant: Liebherr-Werk Biberach GmbH, Biberach an der Riss (DE)

(72) Inventor: Thorsten Hesselbein, Waldshut-Tiengen (DE)

(73) Assignee: Liebherr-Werk Biberach GmbH, Biberach an der Riss (DE)

( * ) Notice: Subject to any disclaimer, the term of this patent is extended or adjusted under 35 U.S.C. 154(b) by 0 days.

(21) Appl. No.: 16/152,800

(22) Filed: Oct. 5, 2018

(65) Prior Publication Data

US 2019/0062127 A1 Feb. 28, 2019

Related U.S. Application Data

(63) Continuation of application No. PCT/EP2017/000426, filed on Apr. 5, 2017.

(30) Foreign Application Priority Data

Apr. 5, 2016 (DE) ..... 20 2016 002 171 U

(51) Int. Cl.

| | |
|---|---|
| ***D07B 1/14*** | (2006.01) |
| ***B66C 15/00*** | (2006.01) |
| ***B65H 63/00*** | (2006.01) |
| ***B65H 63/02*** | (2006.01) |
| ***B65H 63/04*** | (2006.01) |
| ***B66C 15/06*** | (2006.01) |
| ***B66D 1/54*** | (2006.01) |
| ***B66C 13/16*** | (2006.01) |

(Continued)

(52) U.S. Cl.
CPC ..... *B66C 15/00* (2013.01); *B65H 63/00* (2013.01); *B65H 63/02* (2013.01); *B65H 63/04* (2013.01);

(Continued)

(58) Field of Classification Search
CPC ..... D07B 1/145; D07B 2501/2015; B65H 63/00; B65H 63/02; B65H 63/04; B66C 15/06; B66D 1/54
See application file for complete search history.

(56) References Cited

U.S. PATENT DOCUMENTS 8,912,889 B2 12/2014 Sarchi et al.
2008/0105059 A1* 5/2008 Turnbull ..... G01L 1/122 73/779

(Continued)

FOREIGN PATENT DOCUMENTS

DE 19956265 6/2005
DE 102004051594 5/2006

(Continued)

*Primary Examiner* — Andrew W Bee
(74) *Attorney, Agent, or Firm* — Levine Bagade Han LLP

(57) ABSTRACT

The present invention relates generally to lifting gear such as cranes which use ropes such as high-strength fiber ropes. The invention here in particular relates to an apparatus for monitoring operating data and/or for determining the replacement state of such a rope in use on such lifting equipment having a detection device for detecting at least one rope use parameter that influences the replacement state of wear and having a data store for storing the detected rope use parameter and/or an operating parameter derived therefrom that characterizes the residual service life and/or the replacement state of wear of the rope. Provision is made in accordance with the invention that the data store for storing the at least one detected rope use parameter and/or an operating parameter derived therefrom is integrated in the rope, with a reading and/or writing unit connected to the (Continued)

detection device for detecting said rope use parameter being provided to write to the data store in the rope installed at the lifting equipment.

15 Claims, 3 Drawing Sheets

(51) Int. Cl.
*B66C 23/16* (2006.01)
*B66C 23/88* (2006.01)
*G07C 3/02* (2006.01)

(52) U.S. Cl.
CPC ..... *B66C 13/16* (2013.01); *B66C 15/06* (2013.01); *B66C 23/16* (2013.01); *B66C 23/88* (2013.01); *B66D 1/54* (2013.01); *D07B 1/145* (2013.01); *G07C 3/02* (2013.01); *D07B 2501/2015* (2013.01)

(56) References Cited

U.S. PATENT DOCUMENTS

2014/0027401 A1* 1/2014 Ilaka ..... B66C 13/16
212/276
2015/0197408 A1* 7/2015 St. Germain ..... B65H 63/02
340/668
2016/0290963 A1* 10/2016 Silvo ..... B66C 15/06
2016/0325970 A1* 11/2016 Silvo ..... B66C 15/065

FOREIGN PATENT DOCUMENTS

| | | |
|---|---|---|
| DE | 102012105261 | 12/2013 |
| DE | 102012108036 | 12/2013 |
| DE | 102013014265 | 3/2015 |
| DE | 102013017110 | 3/2015 |
| EP | 0749934 | 12/1996 |
| EP | 0731209 | 7/1999 |
| WO | WO 2012/100938 | 8/2012 |
| WO | WO 2017/174191 | 10/2017 |

* cited by examiner

DEVICE FOR MONITORING OPERATING DATA AND/OR DETERMINING THE REPLACEMENT STATE OF WEAR OF A CABLE DURING USE ON LIFTING APPARATUSES

CROSS-REFERENCE TO RELATED APPLICATIONS

This application is a continuation of International Patent Application No. PCT/EP2017/000426, filed Apr. 5, 2017, which claims priority to German Utility Model Application No. 20 2016 002 171.1, filed Apr. 5, 2016, both of which are incorporated by reference herein in their entireties.

BACKGROUND

The present invention relates generally to lifting equipment such as cranes which use high-strength fiber ropes. The invention here in particular relates to an apparatus for monitoring operating data and/or for determining the replacement state of wear of such a rope in use on such lifting equipment having a detection device for detecting at least one rope use parameter that influences the replacement state of wear and having a data store for storing the detected rope use parameter and/or an operating parameter derived therefrom that characterizes the residual service life and/or the replacement state of wear of the rope.

In recent times, trials have been made with cranes to use high-strength fiber ropes made from synthetic fibers such as aramid fibers (HPMA), aramid/carbon fiber mixtures, high-modulus polyethylene fibers (HMPE) or poly(p-phenylene-2,6-benzobisoxazole) fibers (PBO) instead of the proven steel ropes used for many years. The advantage of such high-strength fiber ropes is their low weight. Such high-strength fiber ropes are considerably lighter than corresponding steel ropes at the same rope diameters and the same or higher tensile strength. In particular with high cranes with correspondingly large rope lengths, a greater weight saving is hereby achieved which enters into the dead-weight load of the crane and results in correspondingly higher payloads with an otherwise unchanged construction design of the crane.

A disadvantageous property of such high-strength fiber ropes is, however, their break behavior or their failure without substantial, longer preliminary signs. Whereas the wear is clearly visible in steel ropes and signals a failure over a longer period in advance, for example by the breakage of individual steel wires and a corresponding splaying which is easily noticed, high-strength fiber ropes show hardly any signs of excessive wear which would be easily perceivable for the eye and which would show themselves clearly over a longer period before the actual failure. In this respect, intelligent monitoring measures are required to recognize the replacement state of wear of high-strength fiber ropes in time.

A fiber rope is known from the document US 2015/0197408 A1 in which an indicator strand is embedded, in addition to the fiber bundles transmitting the tensile strength, that is configured as comparatively weaker and that should in every case break before the complete rope failure to provide an advanced warning signal. The indicator strand here has a test signal applied with the aid of an RFID chip and its forwarding or return is impaired on a break of the indicator strand, from which a conclusion can then be drawn on the replacement state of wear. This already known rope admittedly provides a kind of advance or early warning system. However, it is not possible to say how far the rope still is from the replacement state of wear or how far the rope has progressed in its service life or load duration before reaching the replacement state of wear that is shown by break of the indicator strand.

A rope in which an RFID chip is embedded is likewise known from the document DE 10 2012 105 261 A1. Specific manufacturer data such as the batch, the raw materials used, and the stranding speed or stranding date should here be stored in said RFID chip during manufacture during stranding to then be able to draw conclusions on the manufacturing conditions on a later break of the rope or generally on problems with the rope. Due to the previously mentioned influences on the service life of a rope, that differ greatly in dependence on the deployment site and on use and that can result in too great a variance of the actual service life, it is, however, practically not possible to precisely predict the actual replacement state of wear from said data of the rope stored on the manufacturer's side, which, in particular with fiber ropes, can result in an unforeseeable failure or conversely, on a worst-case determination, in a wasting of a fairly large part of the typical service life.

Document U.S. Pat. No. 8,912,889 B2 describes an electrical power cable in which an RFID chip attached to the cable is used to determine the rotation or torsion that occurred during laying or when coiling and uncoiling.

It is to this extent ultimately not reliably and precisely possible with the aforesaid rope systems also to be able to predict the replacement state of wear of a rope under different operating conditions and to be able to analyze a case of damage with reference to the operating conditions. Systems have already been proposed in this regard by means of which operating parameters of lifting equipment such as load hoists and bending cycles can be monitored to be able to draw conclusions on the service life of the system from them.

An apparatus is known from DE 199 56 265 B4 for monitoring the operation of hoist winches on cranes which monitors the rope force of the hoist rope and the lever arm of the hoist rope on the rope winch and determines therefrom the load cycles acting on the rope winch which are stored in a load spectrum counter. This load spectrum counter is integrated into the hoist winch to maintain the history of the hoist winch retraceably on a removal and reinstallation of the hoist winch. A load spectrum counter is furthermore known from EP 0 749 934 A2 which determines the load changes which occur, determines the rope force acting on the hoist winch at each load change, calculates the load spectrum therefrom and calculates and displays the remaining service life of the hoist winch while considering the so-called Wöhler curves.

Such monitoring measures of the hoist winch can, however, not really reliably indicate the remaining service life or the replacement state of a high-strength fiber rope since the high-strength fiber ropes are subject to a variety of strains and impairments which influence the wear and which are independent of the winch strain, for instance e.g. the deflection and bending strains at deflection pulleys external blows and buffets on the rope, surface contamination of components contacting the rope, etc. On the other hand, inflexible service life standards for high-strength fiber ropes are practically incompatible with respect to economic utilization of the actual service life and observation of the required safety since the service life and wear of the high-strength fiber rope can fluctuate strongly in dependence on the conditions of use and on the external influences on the high-strength fiber rope.

It is furthermore known from WO 2012/100938 A1 to monitor a plurality of rope parameters of a high strength fiber rope that indicate characteristic changes when approaching the replacement state of wear. Even if a rope parameter does not show any change or any significant change or any sufficiently strong change, the replacement state of wear can be recognized by monitoring further rope parameters, in particular when a plurality of parameters show changes. The detection device of the apparatus for recognizing the replacement state of wear here comprises a plurality of differently configured detection means for the magnetic, mechanical, optical, and electronic detection of a plurality of different rope parameters that can be evaluated individually and/or in combination with one another by the evaluation unit to recognize the replacement state of wear. Despite the evaluation of a plurality of parameters, however, the problem remains that the replacement state of wear is not always actually present with the same rope parameter changes or there is no fixed connection between individual rope parameter changes and the replacement state of wear. Depending on the individual case, for example, a different meaning for the replacement state of wear can accrue to a change in lateral pressure stiffness or to a number of bending interplays.

Starting from this, it is the underlying object of the present invention to provide an improved apparatus for monitoring the operating influences relevant to the replacement state of wear of high-strength fiber ropes which avoids disadvantages of the prior art and further develops the latter in an advantageous manner. A reliable, precise determination of the replacement state of wear should preferably be made possible which economically utilizes the remaining service life of the fiber rope and which permits the use of the rope on different pieces of lifting equipment without putting safety at risk and managing for this purpose with simple detection devices which also operate reliably under difficult conditions of use for construction machinery.

This object is achieved in accordance with the invention by an apparatus in accordance with claim 1. Preferred embodiments of the invention are the subject of the dependent claims.

It is therefore proposed to monitor rope use parameters and/or operating parameters relevant to the service life of the rope and/or to its replacement state of wear during the use of the rope on the lifting equipment and to store these rope use data or the operating parameters derived therefrom that relate to the operating life and/or replacement state of wear of the rope directly in the rope. Storing operating data that characterize the rope use and/or its effect on the residual service life of the rope directly in the rope has the great advantage that the residual service life or the replacement state of wear of the rope can also be precisely determined when the rope is removed from the lifting equipment and is reinstalled on a different piece of lifting equipment since the rope so-to-say takes along "its" use data and can provide them again to the new lifting equipment and to its evaluation and monitoring devices. Provision is made in accordance with the invention that the data store for storing the at least one detected rope use parameter and/or an operating parameter derived therefrom is integrated in the rope, with a reading and/or writing unit connected to the detection device for detecting said rope use parameter being provided to write to the data store in the rope installed at the lifting equipment. Said reading and/or writing unit is therefore configured and provided to write to the data store integrated in the rope while the rope is used on the lifting equipment or is in its state installed at the lifting equipment in accordance with its intended purpose. The rope use parameter or the operating parameters determined therefrom are stored in the rope or in the data store provided there while the rope is on the lifting equipment.

Said writing and/or reading unit can be installed at the lifting equipment in an advantageous further development of the invention and can communicate with different ropes to this extent. If, for example, a rope ready for replacement is removed and replaced with a new rope, the reading and/or writing unit can also communicate with the new rope.

The rope use parameters stored in the rope can be read out again at a new piece of lifting equipment and can be used by the control and/or evaluation unit of the new piece of lifting equipment to precisely monitor the rope use and the replacement state of wear possibly resulting therefrom when a rope is removed and is installed on another crane. The operation of the lifting equipment can additionally also optionally be blocked if the replacement state of wear has already been stored in a rope and this rope that is to be discarded is accidentally again installed at a new piece of lifting equipment. It can hereby be reliably prevented that ropes that are ready for replacement per se are accidentally used again.

Alternatively or additionally to such a reading and/or writing unit provided at the lifting equipment side, it would, however, also be conceivable to provide a reading and/or writing unit at the rope itself and to communicationally connect it to the detection device for detecting the at least one rope use parameter.

In a further development of the invention, the reading and/or writing unit and the data store can be configured to communicate wirelessly with one another. The data that are written to the data store can be transmitted wirelessly from the reading and/or writing unit to the data store. Conversely, provision can also be made that the data can be wirelessly read out of the data store.

An RFID element can in particular be integrated in the rope as a data store, with in this case the reading and/or writing unit being able to have a radio transmitter and/or a radio receiver, in particular a radio frequency transmitter and radio frequency receiver.

Alternatively or additionally to such an RFID chip, the data store can also comprise other storage means, for example in the form of a remotely readable RAM memory.

It must be noted that separate units can generally be provided for writing to the data store integrated in the rope and for reading the data out of it, for example in the form of a simple writing unit, on the one hand, and a simple reading unit, on the other hand, with it also being able to be sufficient if only the operating data are to be documented to be able to work with a reading unit and only to be able to write data to the data store. However, a reading and writing unit is preferably provided that can both write data to the data store and read data from it.

Said reading and/or writing unit can be directly connected to the detection device that detects the at least one rope wear parameter to be able to store the relevant detected rope use data directly in the data store. Alternatively or additionally, an indirect connection to the use data detection can also be provided, in particular via a control and/or evaluation device that evaluates the detected rope use parameter and determines an operating parameter derived therefrom, for example the residual service life and/or the percentage of the replacement state of wear reached. Such derived operating parameters such as the residual rope operating hours can advantageously be stored in the data store at the rope in addition to the rope use parameters that were directly detected by the detection device. In addition, rope identification data and/or manufacturing data such as the manufacturer batch, stranding characteristics, et cetera can be stored in the data store.

The reading and/or writing unit can generally effect the storage of the data in said data store of the rope and/or the reading of the data therefrom in different manners, for example every time the lifting equipment, for example the crane, is put into operation or shut down. Alternatively or additionally to such a writing/reading at the start and end of an operating phase, the reading and/or writing unit can also be configured such that the detected rope use parameters and/or the operation parameters derived therefrom are cyclically written to the data store of the rope and/or are read out therefrom at predetermined time intervals.

In a similar manner, the reading and/or writing unit can transmit data read out of the data store to a control and/or evaluation device of the lifting equipment, for example in the aforesaid manner in each case at the start or end of an operating phase, in particular on switching on of the lifting equipment and on a shutting down of the lifting equipment and/or in said cyclic manner at temporally predefined intervals. The control and/or evaluation device can then transmit the rope use parameters and/or the operation parameters derived therefrom by remote data transmission, for example, in this manner to a service and/or monitoring station by means of which the operation of the lifting equipment can be remotely monitored and/or remotely serviced.

To enable a reliable, simple data transmission between the data store at the rope and the reading and/or writing unit at the lifting equipment, said reading and/or writing unit and the data store are arranged at spatial proximity in an advantageous further development of the invention. Provision can advantageously be made for this purpose that the data store is integrated in said rope at a rope end section.

In a further development of the invention, the data store can be provided at a rope end that is lashed to a hoist winch, with in this case the reading and/or writing unit advantageously being able to be attached in the region of the hoist winch, in particular at the hoist winch itself. In an advantageous further development of the invention, said reading and/or writing unit can be attached to a guard plate of the drum onto which the rope is wound. It can in particular be advantageous here if the data store is integrated in a rope end section that is end-fastened in the region of said guard plate, for example by means of rope clamps, rope locks, or an end fastening bollard about which a spliced rope eye can be laid.

Alternatively or additionally to such an arrangement of the data store and the reading and/or writing unit at a hoist winch, the data store can also be provided at fixedly lashed end section of the rope, with in this case the reading and/or writing unit advantageously being able to be installed at a structural part of the lifting equipment to which the fixed rope end is lashed or fastened.

The at least one rope use parameter detected by the detection device can generally be of different kinds.

For example, environmental influences and/or weather data to which the rope is exposed when the rope is on the crane can be detected as the rope use parameter and/or as the operation parameter that are relevant to the determination of the replacement state of wear, with the crane operating times and/or down times being able to be taken into account. The detection device advantageously has at least one detection means for detecting environmental influences on the rope that can be evaluated by the evaluation device to recognize the replacement state of wear and are stored in the data store of the rope by the reading and/or writing unit.

Different environmental influences can be relevant and detected to this extent here. For example, particles such as dust, sand, or rust deposited at the rope and/or at the rope drum can result in an increased chafing strain on the rope surface and can hereby accelerate the replacement state of wear. In a further development of the invention, the aforesaid detection means can have a particle detector for detecting the dirt particles present in the environmental air. The evaluation device can then determine the replacement state of wear of the rope in dependence on the dirt particle quantity and/or dirt particle property detected over time.

Alternatively or additionally to the aforesaid environmental influences, the aforesaid detection device can, in a further aspect of the present invention, also have a weather station for detecting weather data to which the crane or the rope provided thereat is exposed and in dependence on which the evaluation device determines the replacement state of wear. Said weather station can here detect different climatic situations that can influence the service life of the rope, for example the temperature and/or the UV radiation and/or the amount of precipitation and/or the precipitation profile and/or the humidity and/or water and/or salt water and/or snow and/or ice that can be stored in the data store at the rope by the reading and/or writing unit.

The evaluation device can here be configured such that it processes one or more of the aforesaid rope use parameters and takes them into account in the determination of the replacement state of wear. The replacement state of wear can, for example, be determined earlier if the rope is frequently exposed to very low and/or very high temperatures and/or is used at very low and/or very high temperatures, that is, it is exposed to loads and is subject to bending cycles. Alternatively or additionally, the replacement state of wear can, for example, be determined earlier if the crane is used in very high radiation environments; that is, the rope is exposed to high UV radiation that can make high strength fiber ropes brittle earlier. Alternatively or additionally, high precipitation rates and/or high moisture and/or greater amounts of snow and ice can be used for a shortening of the service life or for an earlier output of the signal of a replacement state of wear. Alternatively or additionally, it can also be taken into account that salt water at the rope, for example at maritime deployment locations or also the action of water on the rope, for example on uses at deep sea platforms or at rivers, can shorten the service life.

The detection device preferably additionally or additionally to the aforesaid determination means for the weather or for environmental influences comprises a plurality of differently configured detection means for a magnetic, mechanical, optical and/or electronic detection of a plurality of different rope parameters which can be evaluated by the evaluation unit individually and/or in combination with one another for recognizing the replacement state of wear. The use of different rope parameters such as the aforesaid environmental data or weather data or mechanical rope parameters such as the lateral pressure stiffness and cross-sectional change or, alternatively or additionally thereto, a rope lengthening and magnetic rope properties or other mechanical, optical and/or electronic rope parameters for the determination of the replacement state of wear is based on the consideration that depending on the strain and on the effects on the fiber rope, it may from case to case be a different parameter which displays the rope wear or signals the replacement state of wear or the replacement state of wear may also not display itself by an actually larger change of only a single parameter, but rather by smaller changes of a plurality of parameters.

In a further development of the invention, the named evaluation unit is configured such that a replacement signal is provided when at least one of the detected rope parameters or its change exceeds/falls below an associated limit value and also when an indirect rope parameter or its change derived from all detected rope parameters or from a subgroup of the detected rope parameters exceeds/falls below an associated limit value.

In addition to said rope use parameters relating to the environmental influences to which the rope is exposed and/or the weather data present on the use, the system can in particular also take account of the load spectrum acting on the rope and/or of the bending cycles that occur and can store them in the rope. In this respect, the tensile loads acting on the rope and/or the bending cycles acting on the rope can be used as the load spectrum acting on the rope for the determination of the replacement state of wear of the fiber rope. A load spectrum counter can be provided for this purpose which detects at least the tensile rope stress and the number of bending cycles as the load spectrum acting on the fiber rope. The determination and evaluation of the named measured data is possible via corresponding determination means or detection means or sensors whose measured data are processed and evaluated in the evaluation device. A load sensor can in particular detect the ongoing strain of the rope via the operating time of the rope. A rotary encoder on the drum of the rope winch can determine the rope length which is strained to determine the bending cycles. The load data and the data on the rope path and on the bending cycles can be linked to one another in the evaluation device to determine a load spectrum which can be compared with a predefined permitted maximum load spectrum. If the number of the maximum permitted load spectrum is reached, the evaluation unit can output a corresponding replacement signal.

In a further development of the invention, different other rope parameters can be used in addition to the parameters on the environment and on the weather, for example a change of the lateral pressure stiffness or of the rope cross-section. The detection device for detecting rope changes can in particular have lateral pressure stiffness determination means and/or cross-sectional determination means for determining the lateral pressure stiffness or the rope cross-section, wherein the evaluation unit monitors the lateral pressure stiffness or the determined rope cross-section for changes and provides a replacement signal as necessary.

BRIEF DESCRIPTION OF THE DRAWINGS

The invention will be explained in more detail in the following with reference to a preferred embodiment and to associated drawings. There are shown in the drawings.

DETAILED DESCRIPTION

Figure 3:
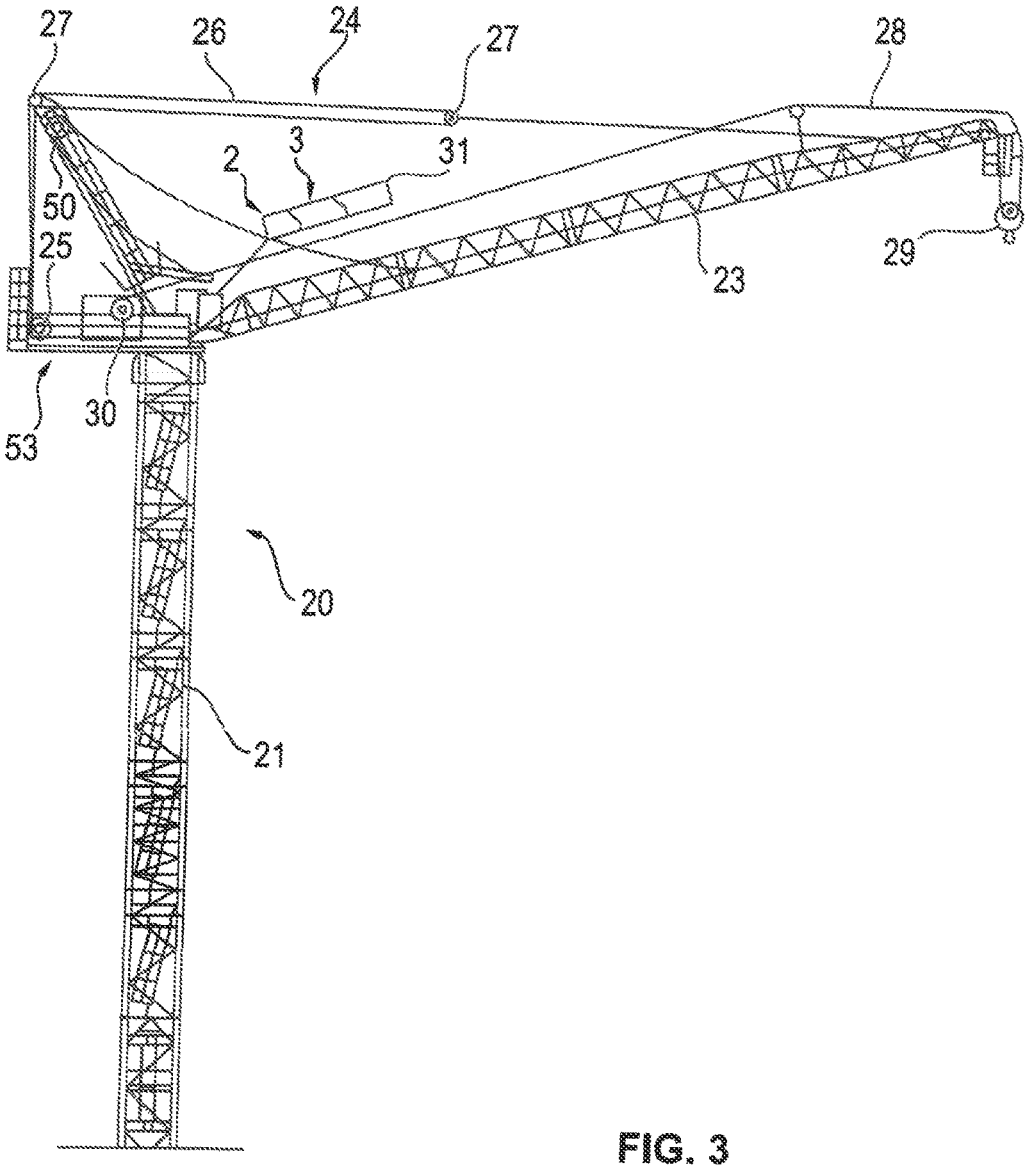
FIG. 3: a schematic representation of a piece of lifting gear in accordance with the invention in the form of a revolving tower crane in accordance with an advantageous embodiment of the invention whose hoist rope and/or whose guy rope for the luffable boom can be configured as a fiber rope.

FIG. 3 shows by way of example for a piece of lifting equipment in accordance with an advantageous embodiment of the invention a crane in the form of a top slewing revolving tower crane 20 whose tower 21 is supported on a carriage or on a stationary base. A boom 23 is pivotably connected in a luffable manner about a horizontal axis in a manner known per se and is guyed via a guying rope arrangement 24. Said guying rope arrangement 24 can be varied in its length via a guying rope winch 25 so that the raised angle of the boom 23 can be changed. For this purpose, a guy rope 26 runs onto said guy rope winch 25. The guy rope 26 or the guying rope arrangement 24 can be guided at a pivot point at the boom 23 close to the tip of the boom 23 via, for example, deflection pulleys 27 at the shown guy brace 50 or a tower tip.

Alternatively, the revolving tower crane 20 can naturally also be provided with a trolley boom. A trolley can be movably supported at the boom 23 and can be moved by means of a trolley rope, for example, which can be guided at the boom tip via deflection pulleys.

The revolving tower crane furthermore comprises a hoist rope 28 which in the drawn embodiment in accordance with FIG. 3 can be let down from the tip of the boom via deflection pulleys and is there connected to a crane hook 29 or can run off via said movable trolley 55 and the deflection pulleys provided there and can be connected to the crane hook 29. Said hoist rope 28 in both cases runs onto a hoist winch 30 which, like the guy rope winch 25 of the embodiment in accordance with FIG. 3, is arranged in the region of the ballast frame or at another support part at the counterboom 53.

Said hoist rope 28 and/or the guy rope 26 can in this respect be configured as a fiber rope which can comprise synthetic fibers such as aramid fibers or an aramid/carbon fiber mixture or can also be formed as a steel strand part or as a mixed form.

Only a rope 1 will be spoken of in the following, with any one of the aforesaid guying ropes or hoist ropes being able to be meant thereby.

To be able to monitor or detect parameters of said fiber rope relevant to the replacement state of wear, a detection device 2 is provided which can be arranged at the crane and which, together with an evaluation device 3 which evaluates the detected parameters, can be connected to or integrated in the electronic crane control unit 31.

The detection device 2 here comprises, as FIG. 3 indicates, various detection means to monitor the rope 1 itself, on the one hand, and to provide rope data and rope features to the evaluation unit 3. The detection means can in particular provide mechanical parameters of the rope 1, for example the make and material of the rope, the minimum rope tension with an empty lifting hook, the maximum permitted rope tension, and the minimum break force of the rope. Said detection means can furthermore provide the lateral stiffness of the rope and/or the bending resistance of the rope and/or the rotational stiffness of the rope, with here the values of said value being able to be provided in the new state of the rope as stored values, on the one hand, and with a continuous monitoring being able to take place. Said rope characteristics such as the lateral stiffness, bending resistance, and rotational stiffness can be monitored and determined by measurement and/or detection means such as is explained in document WO 2012/100938.

The detection means can, for example, also provide visual damage features that can, for example, be detected by a camera and/or can provide operationally induced features that can be determined by data detection at the crane. Said detection means can in particular provide mechanical damage for example in the form of scrub marks at the rope jacket in signal form or also similar damage, for example when the rope jacket has torn and/or has released from the rope. Alternatively or additionally, cut surfaces and/or crushing phenomena of the rope or similar damaged points of the rope jacket and/or of the rope strands due to external influences can be displayed and provided. Alternatively or additionally, a bunch formation can be detected and can be provided by signal technology, for example by a large displacement of the rope strands. Alternatively or additionally, a high rotation of the rope jacket and/or rotations per length unit can also be determined and provided.

Depending on the degree of defectiveness with respect to said features, the evaluation unit 3 can provide a replacement state signal and/or a residual service life signal.

The detection means can furthermore determine operationally-induced features by corresponding measurement devices and can provide them to the evaluation device, for instance changes of the rope diameter and/or a rope stretch, for example. A rope efficiency can furthermore be determined, that is, changes due to the aging and to the operating time. Alternatively or additionally, the rope temperature can be detected that occurs due to the crane operation and to the environmental temperature during crane operation. If, for example, a maximum permitted rope temperature is exceeded, a switch to adapted part load operation can be made to maintain the rope safety. Alternatively or additionally, the aging of the rope can in particular be determined in the form of a seated time reached, with a maximum permitted seated time being able to be evaluated in dependence on different factors of influence.

Furthermore, various crane data can be supplied to the evaluation device 3, for example construction data and crane settings such as the diameter of hoisting drums and rope pulleys, rope lengths, and rope diameters, the number of reevings, drum measurements in the form of the drum diameter and the jacket length, the number of maximum rope layers on the drum and the number of windings and/or the maximum rope speeds provided for the respective rope.

Furthermore, operation data can also be provided as crane data that can be detected by means of corresponding detection means during crane operation, for example the load range occurring in operation and the time of the load, a load measurement with respect to a rope strand that can, for example, take place by a load sensor, and/or the hoisting height or the rope path length in dependence on the load cycle, with a measurement here, for example, being able to take place by a revolution sensor of the hoisting drum. Alternatively or additionally, the actually run rope speed can be measured, for example by a corresponding revolution speed sensor at the hoisting drum.

Said detection device 2 can in particular also comprise detection means for detecting the load spectrum acting on the respective fiber rope 1, with here at least the tensile load acting on the rope and the number of bending cycles, but advantageously also other parameters influencing the long-term strength such as multilayer coiling, environmental influences, temperature, transverse strains and others, advantageously being able to be detected here.

To determine said parameters, said detection means comprise corresponding sensors whose signals are supplied to said evaluation unit 3. A load measurement sensor can in particular detect the current load over the operating time of the rope. Furthermore, a rotary encoder on the respective winch drum can advantageously measure the rope length which is strained. In sum, a load spectrum can be determined from this, for example in the form of a Wohler curve, which can be compared with a predefined maximum load spectrum for the fiber rope 1. If the number of the maximum permitted load spectra, that is, a specific number of bending cycles under the influence of a specific load and/or specific load peaks, is reached, a warning and/or a specification of time in which the rope change has to take place is/are carried out.

The detection device 2 furthermore has detection means for detecting environmental influences that act on the ropes 1 provided at the respective crane. Said detection means can advantageously likewise be provided at the respective crane.

Alternatively or additionally to the aforesaid environmental influence detection means, the detection device 2 can furthermore also comprise weather data detection means by means of which possible climatic situations can be detected that can influence the service life of the rope. Said detection means can be arranged, for example, in the form of a weather station at the respective crane or in direct proximity hereto and can provide corresponding weather data to the evaluation device 3.

The rope use parameters detected by the detection device 2 and/or the operation parameters derived therefrom by the evaluation device 3 such as the residual service life or the replacement state of wear are advantageously written by means of a reading and/or writing unit to a data store 5 that is integrated in the rope 1, in particular in a rope end section of the rope 1. Said data store 5 can here have different embodiments in the initially explained manner and can in particular be configured in the form of an RFID chip.

Said data store 5 can here in particular be arranged in the interior of the rope 1 or can be embedded in the rope to protect the data store from damage due to external influences. To the extent that the data store 5 can be provided at the rope end, it is, however, also possible to attach the data store 5 at the outer side or at the exterior of the rope 1 since the rope end typically does not run through rope guide means or over deflection pulleys.

If the data store is an RFID chip in the named manner, the reading and/or writing unit 4 can have a radio receiver and transmitter that can communicate with said RFID chip.

Figure 1:
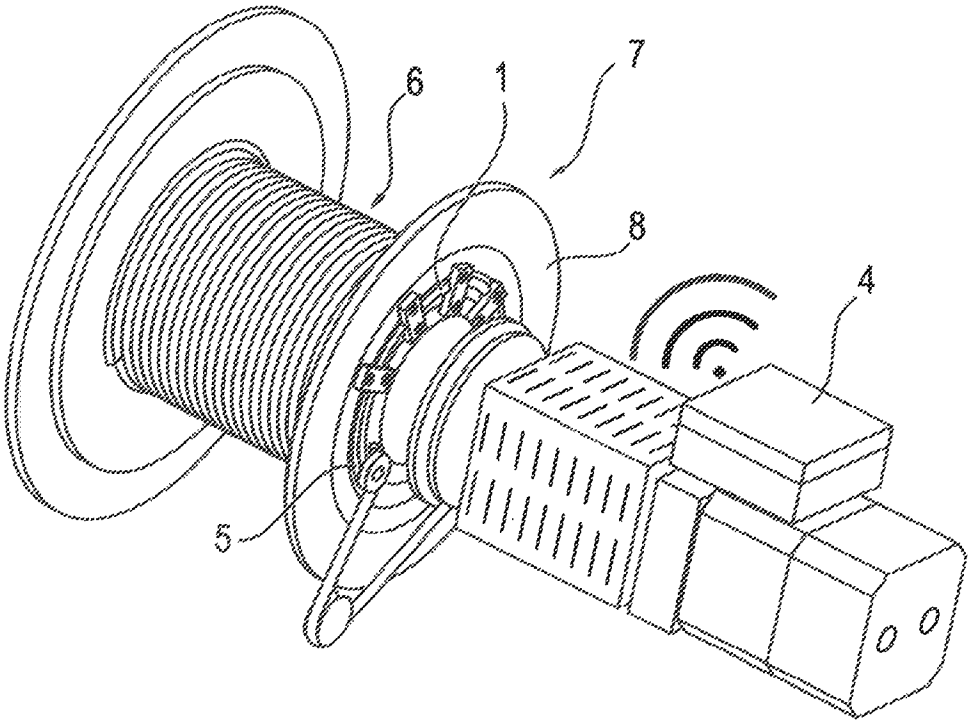
FIG. 1: a schematic representation of the hoist winch of a piece of lifting equipment, in particular in the form of the hoist winch of a crane such as a revolving tower crane, with the rope wound around the hoisting drum having, in accordance with an advantageous embodiment of the invention, a rope end fastened to the guard plate of the hoisting drum in which a writable data store is integrated, with a reading and/or writing unit being provided that can communicate with said data store.

As FIG. 1 shows, said data store 5 can advantageously be integrated in the rope end of the rope that is fastened to the hoisting drum 6 of a hoist winch 7. As FIG. 1 shows, it can be advantageous here if said rope end is fastened to the guard plate 8 of the hoisting drum 6, for example to its outer side, and if the data store 5 is integrated in a rope section that is fastened to said guard plate 8.

With an arrangement of the data store 5 disposed at the outer side of the guard plate 8, a communication link to the reading and/or writing unit 4 can be set up in a simple manner, in particular when the latter is likewise arranged in the region of the hoist winch 7, in particular in direct proximity to said guard plate 8, for example directly opposite said guard plate 8 and/or at a drive unit for driving the drum. The reading and/or writing unit 4 itself can here also be attached or installed at the guard plate 8.

Figure 2:
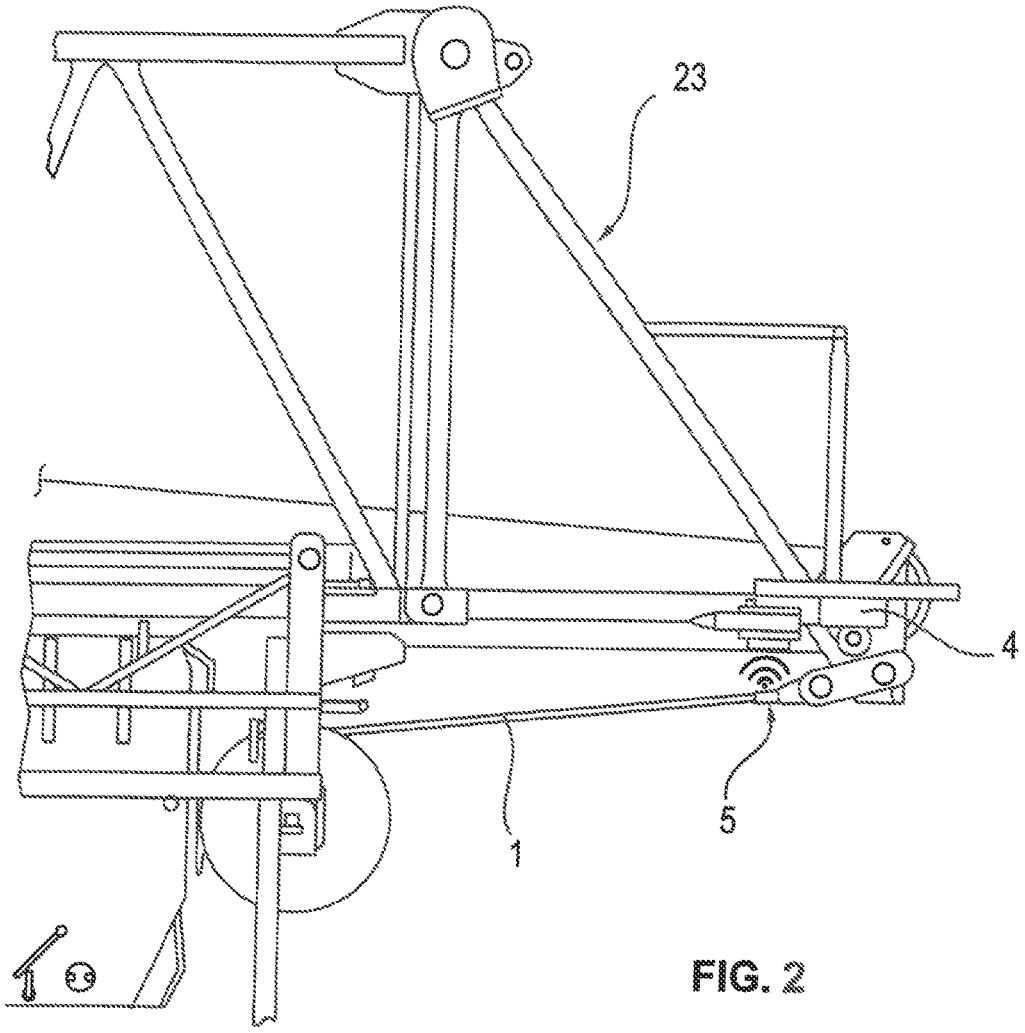
FIG. 2: a schematic representation of an embodiment of the invention in which the data store is integrated in a fixed rope end and the reading and/or writing unit is installed at the structural part of the lifting equipment, in particular at a crane boom element, to which the fixed rope end is fastened.

Alternatively or additionally to the arrangement of the data store 5 shown in FIG. 1 at a rope end fastened to the winch side with an arrangement of the reading and/or writing unit 4 associated with the hoist winch, the data store 5 can also, as FIG. 2 shows, be arranged at a fixed rope end of the rope 1. As FIG. 2 shows, a rope end of the rope 1 can be firmly lashed to a structural part of the lifting equipment, in particular of the crane, such as a crane boom, with the data store being able to be integrated in the rope end section that is firmly lashed to the structural part in the manner shown in FIG. 2.

The reading and/or writing unit 4 can advantageously be installed at said structural part of the lifting equipment, in particular in proximity to the firmly lashed rope end, in particular to the boom part of the crane, as shown in FIG. 2.

I claim:

1. An apparatus for monitoring operating data and/or for determining the replacement state of wear of a rope in use with lifting equipment comprising a crane, comprising:

a detection device for detecting at least one rope use parameter influencing the replacement state of wear and having a data store for storing the rope use parameter and/or an operation parameter derived therefrom, wherein the data store is integrated in the rope;

a first reading and/or writing unit connected to the detection device, wherein the reading and/or writing unit is provided to write to the data store; and the rope installed in the lifting equipment.

2. The apparatus of claim 1, wherein the first reading and/or writing unit is installed in the lifting equipment.

3. The apparatus of claim 1, wherein the first reading and/or writing unit and the data store are configured to communicate wirelessly with one another.

4. The apparatus of claim 1, wherein the data store comprises an RFID element and the first reading and/or writing unit comprises a radio transmitter and/or a radio receiver.

5. The apparatus of claim 1, wherein the first reading and/or writing unit is installed at a hoist winch comprising a drum, and wherein the rope is wound about the drum of the hoist winch.

6. The apparatus of claim 5, wherein the first reading and/or writing unit at or opposite of a guard plate of the drum in the region of a rope end fastening.

7. The apparatus of claim 5, wherein the data store is integrated in a rope end section of the rope that is fastened to a guard plate of the drum of the hoist winch.

8. The apparatus of claim 1, wherein the first reading and/or writing unit is installed at a structural part of the lifting equipment in the region of the fastening point of a fixed rope end of the rope, and wherein the data store is integrated in the fixedly installed rope end.

9. The apparatus of claim 1, further comprising a second reading and/or writing unit, and wherein the second reading and/or writing unit is installed at a structural part of the lifting equipment in the region of the fastening point of a fixed rope end of the rope, and wherein the data store is integrated in the fixedly installed rope end.

10. The apparatus of claim 1, wherein the first reading and/or writing unit is configured to write the at least one rope use parameter and/or the operation parameter derived therefrom to the data store and/or to read it from the data store for each event of putting the lifting equipment into operation and/or taking the lifting equipment out of operation.

11. The apparatus of claim 1, wherein the first reading and/or writing unit is configured to write the at least one rope use parameter and/or the operation parameter derived therefrom to the data store and/or to read from it cyclically at predefined time intervals.

12. The apparatus of claim 1, wherein the first reading and/or writing unit is configured to read out the at least one rope use parameter stored in the data store and/or the operation parameter stored in the data store for each event of putting the lifting equipment into operation and/or to read the at least one rope use parameter out cyclically at predefined time intervals and to transmit the at least one rope use parameter to a control and/or evaluation device of the lifting equipment.

13. The apparatus of claim 1, wherein the detection device has at least one of the following detection means whose detection data can be evaluated by an evaluation device for determining the replacement state of wear:

a detector for detecting weather data and/or climate data present at the lifting equipment;

a UV radiation sensor comprising a radiation dosimeter, wherein the UV radiation sensor is for determining the UV radiation acting on the rope;

a particle detector for detecting the dirt particles present in the environmental air, wherein the dirt particles comprise dust and/or sand and/or soot;

a lubricant detector for detecting lubricants acting on the rope, wherein the lubricants comprise oils and grease;

a smectite sensor for detecting smectite;

a chemical sensor for detecting chemicals degrading the rope;

a snow and/or ice sensor for detecting snow and/or ice;

a precipitation and/or moisture sensor for determining a precipitation profile and/or moisture; and a salt content determiner for determining the salt content in the determined moisture.

14. The of claim 1, wherein the detection device comprises a plurality of differently configured detectors for determining a plurality of different rope use parameters that can be evaluated by an evaluation device for recognizing the replacement state of wear of the rope.

15. A lifting equipment comprising a revolving tower crane, a harbor crane or a telescopic crane, wherein the lifting equipment comprises a rope and the apparatus of claim 1.

* * * * *